US006494429B2

(12) United States Patent
Tajima

(10) Patent No.: US 6,494,429 B2
(45) Date of Patent: Dec. 17, 2002

(54) PANEL SUPPORT STRUCTURE, DISPLAY PANEL SUPPORTED BY PANEL SUPPORT STRUCTURE, AND IMAGE FORMING APPARATUS USING DISPLAY PANEL

(75) Inventor: Hisao Tajima, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/127,977

(22) Filed: Aug. 3, 1998

(65) Prior Publication Data

US 2002/0043607 A1 Apr. 18, 2002

(30) Foreign Application Priority Data

Aug. 4, 1997 (JP) ..... 9-209261
Jul. 31, 1998 (JP) ..... 10-217990

(51) Int. Cl.[7] ..... A47F 1/14

(52) U.S. Cl. ..... 248/473; 248/918; 248/903; 361/681

(58) Field of Search ..... 248/473, 903, 248/918; 361/681; 52/204.591, 204.593

(56) References Cited

U.S. PATENT DOCUMENTS

| | | | | | |
|---|---|---|---|---|---|
| 3,652,380 | A | * | 3/1972 | Strack | 52/204.591 |
| 3,828,215 | A | * | 8/1974 | Bilsback | 313/50 |
| 3,893,271 | A | * | 7/1975 | Kotlarz | 52/204.591 |
| 4,006,569 | A | * | 2/1977 | Kain | 52/204.597 |
| 4,139,973 | A | * | 2/1979 | Fujita et al. | 52/204.591 |
| 4,327,535 | A | * | 5/1982 | Governale | 52/204.593 |
| 4,615,159 | A | * | 10/1986 | Kessler | 52/204.593 |
| 4,831,804 | A | * | 5/1989 | Sayer | 52/204.593 |
| 5,150,231 | A | | 9/1992 | Iwamoto et al. | 359/44 |
| 5,268,816 | A | * | 12/1993 | Abell, Jr. et al. | 361/729 |
| 5,517,208 | A | | 5/1996 | Mori et al. | 345/87 |
| 5,583,529 | A | * | 12/1996 | Satou | 361/681 |
| 5,583,681 | A | | 12/1996 | Shioya et al. | 349/60 |
| 5,768,096 | A | * | 6/1998 | Williams et al. | 361/681 |
| 5,835,343 | A | * | 11/1998 | Johns et al. | 361/681 |
| 5,928,320 | A | * | 7/1999 | Forsythe | 361/681 |

FOREIGN PATENT DOCUMENTS

| | | |
|---|---|---|
| JP | 50-114998 | 9/1975 |
| JP | 59-161470 | 10/1984 |
| JP | 61-41352 U | 3/1986 |
| JP | 63-120286 U | 8/1988 |
| JP | 64-86292 | 3/1989 |
| JP | 3-36164 U | 4/1991 |
| JP | 3-63236 U | 6/1991 |
| JP | 3-219212 | 9/1991 |
| JP | 4-59878 U | 5/1992 |
| JP | 4-129178 U | 11/1992 |
| JP | 4-369631 | 12/1992 |
| JP | 5-11183 | 2/1993 |
| JP | 7-83260 | 3/1995 |
| JP | 9-114391 | 5/1997 |

* cited by examiner

*Primary Examiner*—Kimberly Wood
(74) *Attorney, Agent, or Firm*—Fitzpatrick, Cella, Harper & Scinto

(57) ABSTRACT

A panel support structure for supporting a flat display panel capable of reducing the weight of the panel support structure while a sufficient structural strength is maintained and capable of preventing the display performance of the flat display panel from being lowered by a change in an ambient temperature. A flat display panel is fixedly supported by an X-character shaped supporting member via dampers fitted in the four corners of the flat display panel by the flat panel fixing parts of the supporting member. The supporting member is disposed along diagonal lines extending between the four corners of the flat display panel and has a rectangular cross section whose longer side is directed in the thickness direction of the flat display panel.

14 Claims, 6 Drawing Sheets

1
2
3
4
5
6
7
8
9
10
11
12
Y - DIRECTION
X - DIRECTION
Z - DIRECTION

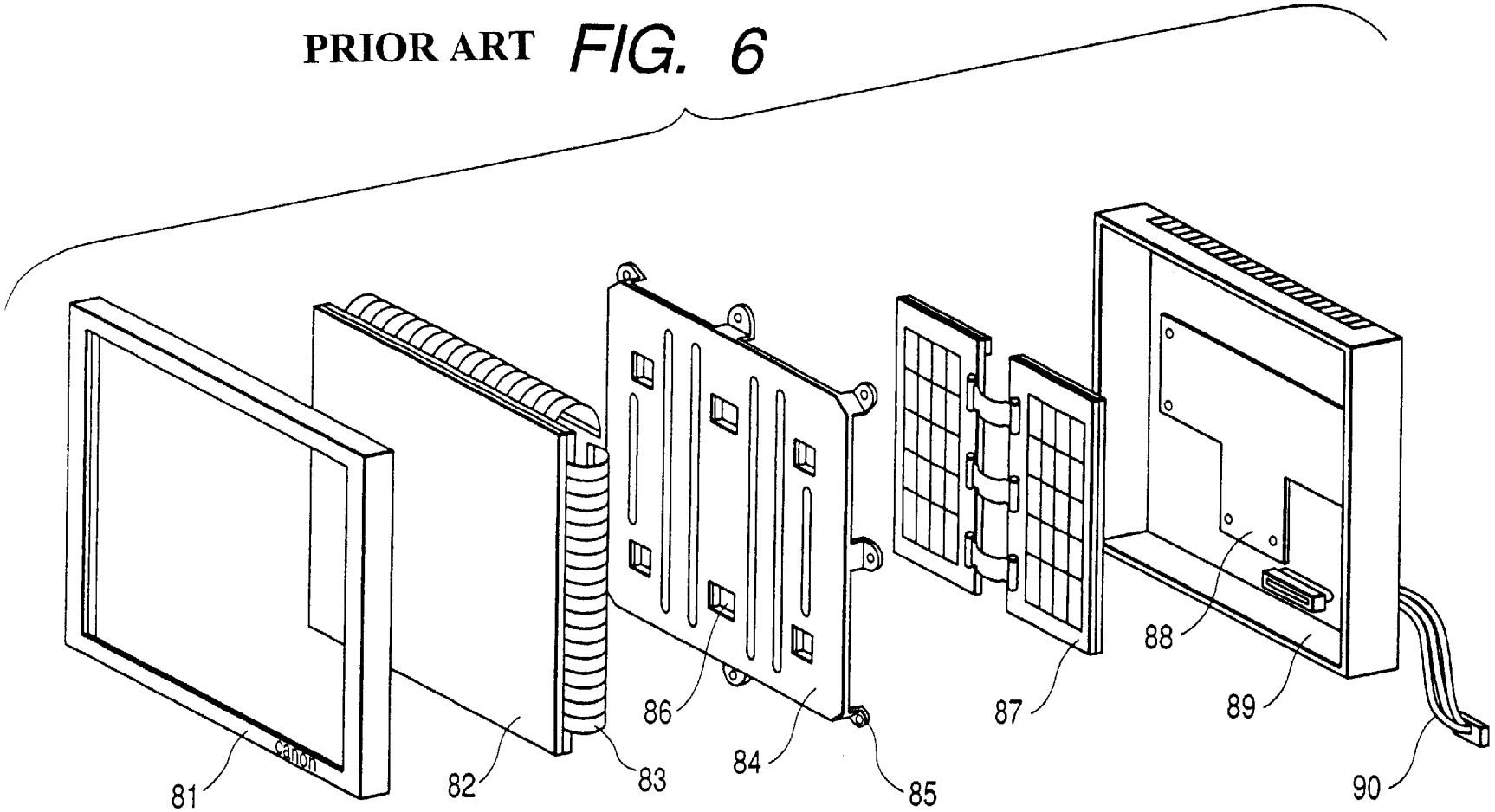
PRIOR ART FIG. 6

PRIOR ART FIG. 7
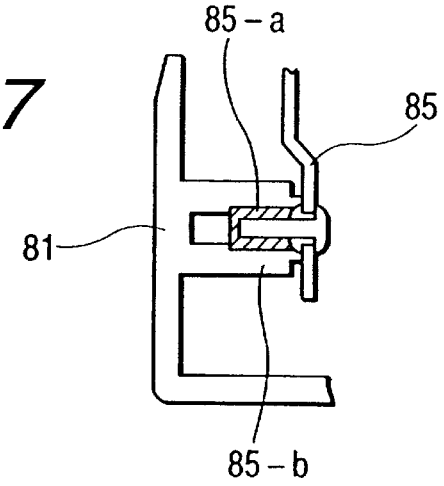
FIG. 8
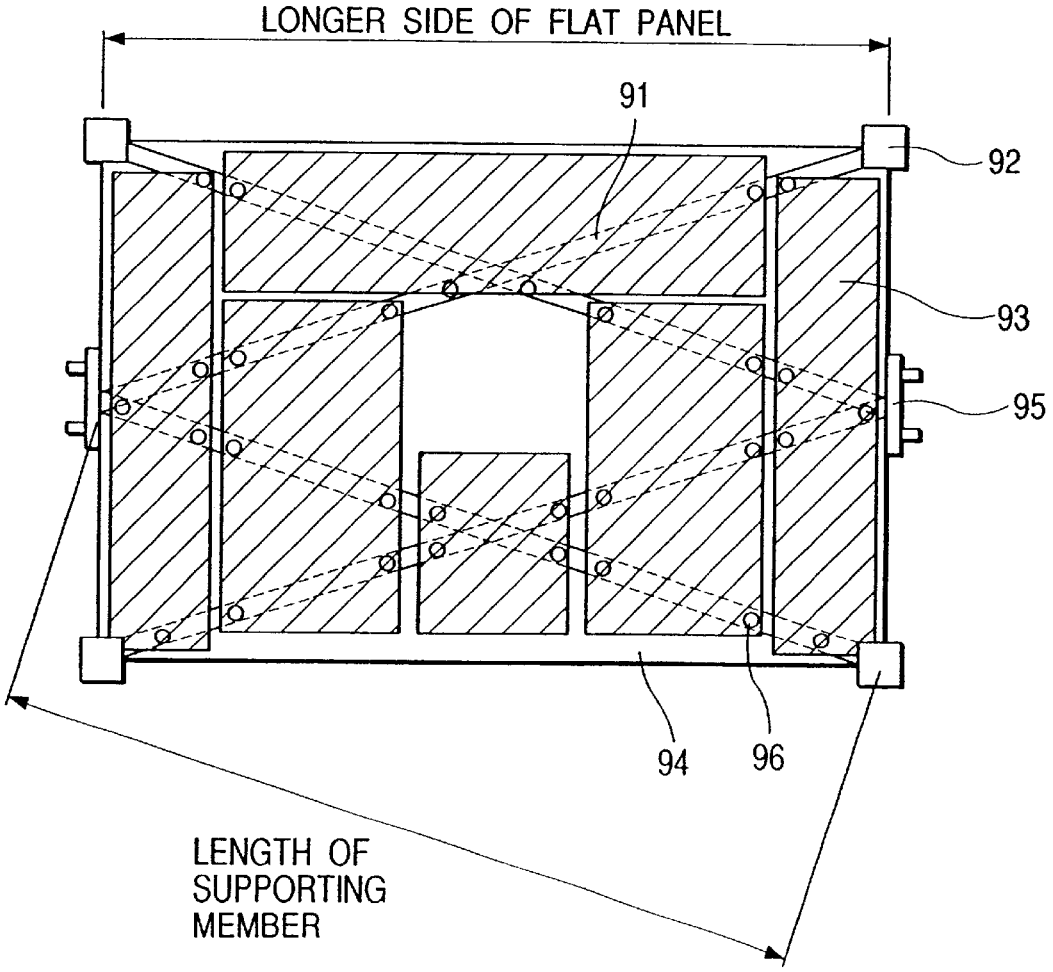

PANEL SUPPORT STRUCTURE, DISPLAY PANEL SUPPORTED BY PANEL SUPPORT STRUCTURE, AND IMAGE FORMING APPARATUS USING DISPLAY PANEL

BACKGROUND OF THE INVENTION

1. Field of the Invention

The present invention relates to a reinforced support structure for supporting a display panel, a panel display device supported by the support structure and having a supporting member, and an image forming apparatus using the panel display device.

2. Related Background Art

A flat plane image forming apparatus has been used for the image display on televisions and computers, advertisement media, sign boards and the like. Flat plane image forming apparatuses include those image forming apparatuses using a display panel using electron emitting elements, a display panel using plasma discharge, a display panel using liquid crystal, and the like. A wall hanging type, a wall embedded type, a desktop type, a floor type and the like are known as display panel mount types.

An example of a conventional mount structure for an image forming apparatus with a display panel using plasma discharge is shown in FIG. 6. The main components of this structure are constituted of: a front cover (bezel) 81 for protecting a display panel 82 using plasma discharge; a flexible flat cable 83 for transferring electrical signals to the display panel; a chassis 84 for supporting the display panel, the chassis being made of iron-based material and formed through sheet plate work; mount members 85 for mounting the front cover 81, the mount members being formed at the peripheral area of the chassis; screw threading members 86 for fixing an electronic component mounting board 87, the screw threading members being formed through cutting and bending the chassis 84 and the electronic component mounting board 87 being used for processing externally input electrical signals and supplying them to the display panel; a rear cover 89 having a reinforcing plate 88 for mounting the image forming apparatus on an external wall hanger or desktop stand (not shown); and a cable 90 for electrical connection of the electronic component mounting board 87 to an external power source and tuner (not shown).

FIG. 7 is an enlarged cross sectional view showing a partial area of the image forming apparatus shown in FIG. 6. In FIG. 7, a pit inserting screw 85-*a* and a boss 85-*b* of the front cover 81 into which the screw is inserted, are illustrated.

The detailed descriptions of the function and aspects of this mount structure will be further given. The display panel 82 is made of two glass substrates adhered together with a space being provided therebetween. This space is filled with specific rare gas and thereafter hermetically sealed. The inner surfaces of the opposing two glass substrates are formed with an electrode film, an insulating film, a fluorescent film, and a shielding film. Electrical signals supplied from the electronic component mounting board 87 via the flexible flat cable 83 are applied to the electrode film (X, Y matrix patterns) to drive a pixel element. As a predetermined voltage is applied to the pixel element, rare gas near the pixel element emits ultraviolet rays which excite the fluorescent film to emit light. Each pixel of the fluorescent film is divided into red, green and blue areas in chromaticity to thereby realize a color image.

The chassis 84 is used for supporting the display panel 82 in the housing of the image processing apparatus, the chassis 84 and display panel 82 being fixed together by using a both-side adhesive tape (not shown). The material of the chassis 84 is made of a rigid metal plate (such as a galvanized steel sheet) in order to reliably support the display panel 82. The mount members 85 with a small through hole are provided at the peripheral area of the chassis 84 in order to mount the front cover 81 by using the screws 85-*a* threaded into the bosses 85-*b* of the front cover 81. On the back side of the chassis 84, the screw threading members 86 with a screw hole 86 are provided in order to mount the electronic component mounting board 87 by using screws.

On the inner side of the rear cover 89, the reinforcing plate 88 is fixed in order to mount the image forming apparatus on an external wall hanger or desktop stand by using screws which are threaded into the reinforcing plate 88.

SUMMARY OF THE INVENTION

The invention provides a novel panel support structure.

According to one aspect of the present invention, a panel support structure for supporting a panel for displaying an image is provided, which comprises a holding member for holding the panel which astride an edge of the panel.

With this structure, the panel is supported at peripheral two contrary surfaces thereof. Therefore, even if there is a size error or change between the panel and the support structure, it is still possible to support the panel. For example, the panel can be supported even if expansion or contraction by a temperature change (an ambient temperature change or a temperature change caused by a heat generation change of the panel) affects the size error or change. In this case, a substantial overlap amount between the holding member and the two contrary surfaces of the panel is determined under consideration of the degrees of thermal expansions of the panel and the panel support structure. The substantial overlap amount is, for example, an overlap amount between a damper and the surface of the panel, if the panel support structure holds the panel by using the holding member, with the damper to be described later being interposed therebetween.

The holding member may be provided at the four corners of the panel. A deflection of the panel can be suppressed more reliably if a holding portion is provided not only at the corner of the panel but also at the whole side of the panel or at a plurality of positions of the panel. It is not necessary to provide the holding portion at all the four sides. It is however preferable to provide the holding portion at least at the opposing two sides of the panel.

With this structure, a plurality of holding members may be provided to support the panel at a plurality of positions and to couple the holding members to a supporting member. The holding member and the supporting member may be formed integrally or separately.

The holding member may be provided with a damper at a position where the panel becomes or possibly becomes in contact with the holding member. The damper may be made of rubber. The rubber hardness is preferably 50 (JIS-A) or higher.

It is preferable to use as the material of the supporting member a material other than glass, such as metal.

If the supporting member is made of a rod-like member, the weight thereof can be reduced. Wherein, rod-like member includes an elongated plate member. The supporting member may be a combination of a rod-like members and a plate member. It is preferable that a length of the rod-like member along a longitudinal direction is longer than a length of a longer side of the panel. A plurality of rod-like members may be used. The rod-like members may be crossed each other. For example, the rod-like members are disposed in an X-character shape. If the rod-like members are crossed each other, it is preferable that they are fixed at the cross points. The supporting member with the cross points may be formed integrally or separately. The rod-like member has a rectangular or circular cross section. It is preferable that a length of the cross section of the rod-like member along a thickness direction of the panel is longer than a length of the cross section along a direction parallel to a surface of the panel. While it may be reversed, when the supporting structure is to be thinner. It is also preferable (in the earlier case) that a length of the cross section of the rod-like member along a thickness direction of the panel is 1/80 or longer than a diagonal line of the panel.

The thermal conduction of the panel differs at respective positions where it is in contact with the supporting member or not in contact. If a difference of the thermal conductivity may pose some practical problem, it is preferable that the supporting member is made in contact with the panel only at a portion of the supporting member or not in contact with the panel. A heat insulating member or a protective buffer may be inserted between the panel and the supporting member.

According to another aspect of the present invention, a panel support structure for supporting a panel for displaying an image is provided which comprises a supporting member having a rod-like member made of a material different from a material of the panel, wherein a length of the rod-like member along a longitudinal direction is longer than a length of a longer side of the panel.

This panel support structure may take various configurations similar to the holding member. As described earlier, the panel may be supported at its corner or at its side.

As the material of the supporting member, metal may be used if the panel is made of glass. A plurality of rod-like members may be used. The rod-like members may be crossed each other. For example, the rod-like members are disposed in an X-character shape. If the rod-like members are crossed each other, it is preferable that they are fixed at the cross points. The supporting member with the cross points may be formed integrally or separately. The rod-like member has a rectangular or circular cross section. In this case, it is preferable that a length of the cross section of the rod-like member along a thickness direction of the panel is longer than a length of the cross section along a direction parallel to a surface of the panel. It may be reversed, when supporting structure is to be thinner. It is also preferable (in the earlier case) that a length of the cross section of the rod-like member along a thickness direction of the panel is 1/80 or longer than a diagonal line of the panel (particularly when the rod-like members are disposed along diagonal lines of the panel).

The thermal conduction of the panel differs at respective positions where it is in contact with the supporting member or not in contact. If a difference of the thermal conductivity may pose some practical problem, it is preferable that the supporting member is made in contact with the panel only at a portion of the supporting member or not in contact with the panel. A heat insulating member or a protective buffer may be inserted between the panel and the supporting member.

The panel support structure according to each of the aspects of the present invention may have the following configurations.

The panel support structure may be used as an electrical ground. For example, the panel support structure may have a mount portion for mounting a cover which accommodates at least a portion of a panel display device including the panel and the panel support structure. In this case, if the inner surface of the cover is made conductive by coating a conductive film on the inner surface through plating or painting, the cover and the panel support structure may be electrically connected at the mount portion to ground the cover.

The panel support structure may be partially provided with a mount portion for mounting a circuit board for controlling or driving the panel. A ground level wiring line (pattern) of the circuit board may be connected to the panel support structure via the mount portion.

If the panel support structure and the cover are made in contact with each other on flat surfaces, the reliability of the electrical connection can be improved. As a means for mechanically coupling the panel support structure to the cover, screws may be used. Similarly, if the panel support structure and the circuit board are made in contact with each other on flat surfaces, the reliability of the electrical connection can be improved. Also, as a means for mechanically coupling the panel support structure and the cover, screws may be used.

An installing member such as a desktop stand or wall hanger is sometimes used for installing a panel display device including the panel and panel support structure. In this case, it is preferable that the panel support structure has a mount portion for mounting the installing member. If the mount portion is provided near at an end of the panel display device, the panel device can be installed more stably. If the mount portion is provided near at a center of the panel or the center of gravity of the panel, it becomes easy to adjust the direction and angle of the panel display is device and the display screen becomes hard to be fluctuated by external vibrations.

The invention also includes the following configurations.

A panel support structure for supporting a panel for displaying an image which comprises a mount portion for mounting an installing member for installing a panel device including the panel and the panel support structure.

A panel support structure for supporting a panel for displaying an image wherein at least a portion of the panel support structure is conductive and electrically grounded.

The invention also includes a panel display having the panel and the panel support structure described above.

The invention also includes an image forming apparatus using the panel display device.

The present invention can solve at least some of the following problems which the panel support structure shown in FIG. 6 cannot solve.

1. The chassis 84 for supporting the display panel 82 in the housing of the flat plane type image forming apparatus is generally made of an iron-based plate formed through sheet plate work. Therefore, the weight of the image forming apparatus increases and transportation thereof becomes difficult, or it becomes necessary to reinforce a wall itself on which the wall hanger is mounted.
2. Since the materials of the display panel 82 and chassis 84 are different, a difference between the sizes of these two devices becomes large as an ambient temperature changes so that the display panel 82 may be deformed and the display performance thereof may be degraded.
3. In order to suppress electromagnetic radiation noises to be generated from the display panel 82 and electronic component mounting board 87, it is necessary to form a conductive film on the surfaces of the front cover 81 and rear cover 89 and electrically ground the conductive films. In this context, however, when the pit inserting screw 85-*a* is heated and inserted into the boss 85-*b* of the front cover 81, resin of the material of the front cover is melted and the flat surface of the boss 85-*b* is formed with a swelled resin region which unstabilizes the surface contact with the screw mounting member of the chassis 85. Therefore, leakage of electromagnetic radiation noises may occur.

4. Under the condition that the flat plane image forming apparatus is mounted on the external wall hanger or desktop stand, the reinforcing plate 88 supports the heavy display panel 82 and chassis 84 via the rear and front covers. Therefore, when a user wants to change the direction of the display screen, it is not easy to fix the direction because of this mount structure or because the display screen may fluctuate when there is a vibration even if it is small.
5. Heat generated by the display panel 82 directly transmits to the chassis 84 and thermally affects the electronic component mounting board 87, or conversely, heat generated by the electronic component mounting board 87 thermally affects the display panel 82 via the chassis 84. Therefore, the display performance of the display panel 82 may be deteriorated or the electrical characteristics of the electronic component mounting board 87 may be affected.
6. Since the power source and tuner are not built in the flat plane type image forming apparatus mounted on the wall, another mount space for the power source and tuner is required and the cable 90 is required to be connected to the power source and tuner. Therefore, the mount site of the flat plane type image forming apparatus is limited to particular areas.
7. Since the both-side adhesive tape is used for adhering the display panel 82 and chassis 84, materials of the apparatus are difficult to be separated when the apparatus is dumped.

BRIEF DESCRIPTION OF THE DRAWINGS

FIG. 6 is a broken perspective view of a conventional image forming apparatus.

FIG. 7 is an enlarged cross sectional view showing a partial area of the image forming apparatus shown in FIG. 6.

FIG. 8 is a schematic diagram showing a flat plane image forming apparatus according to a fourth embodiment of the invention.

DETAILED DESCRIPTION OF THE PREFERRED EMBODIMENTS

The invention will further be detailed in connection with the preferred embodiments.

[First Embodiment]

Figure 1:
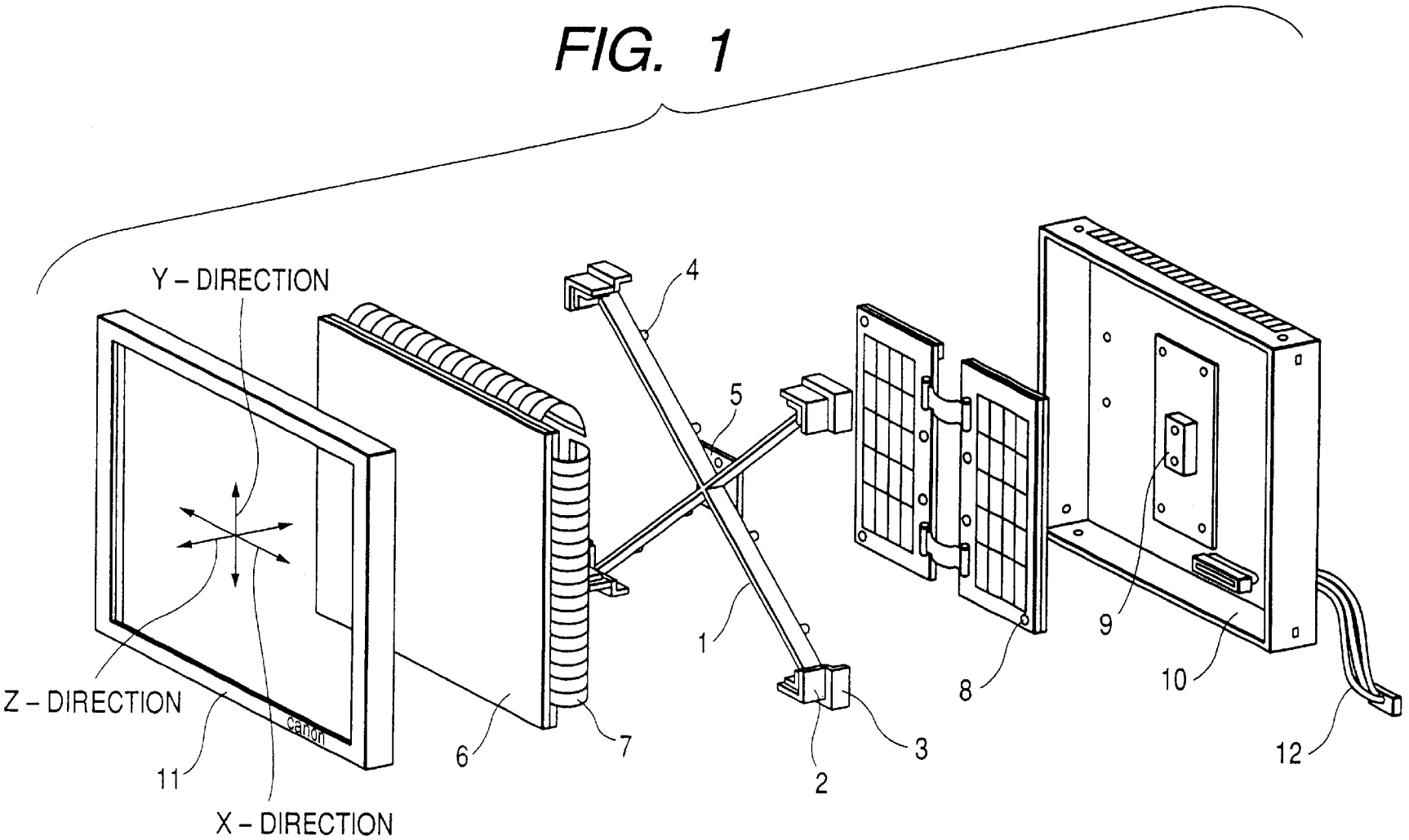
FIG. 1 is a broken perspective view of an image forming apparatus according to a first embodiment of the invention.

FIG. 1 is a schematic diagram showing the structure of a flat plane type image forming apparatus according to the first embodiment of the invention. In this embodiment, a flat panel is supported by an X-character shaped supporting member 1. The main components of this structure are constituted of: the X-character shaped supporting member 1 made of a rigid material; a flat panel fixing part 2 provided at each end of the supporting member 1; a cover fixing part 3 provided at each of the supporting member 1; threaded mount members 4 formed on the supporting member 1 for mounting an electronic component mounting board 8; a screw mounting member 5 formed on the supporting member 1 for mounting the supporting member on a reinforcing plate 9; a flat panel 6 made of a pair of glass substrates coupled together and having its electric wiring connection; a flexible flat cable 7 for supplying electric signals and voltages for image display; the electronic component mounting board 8 for processing external signals and supplying the processed signals to the flat panel; the reinforcing plate 9 for mounting the image forming apparatus on a wall hanger or desktop stand (not shown); a rear cover 10 with heat dissipating holes, the rear cover being used for the apparatus protection and decoration; a front cover 11 with an opening having an area corresponding to the display screen, the front cover being used for the apparatus protection and decoration; and an input cable 12 for the electrical connection of the electronic component mounting board 8 to an external power source and tuner (not shown). Wherein, edges of the fixing part 2, the buffer member 13 and the supporting member 1 operate as astride holding member portion over the panel edge.

Figure 2A:
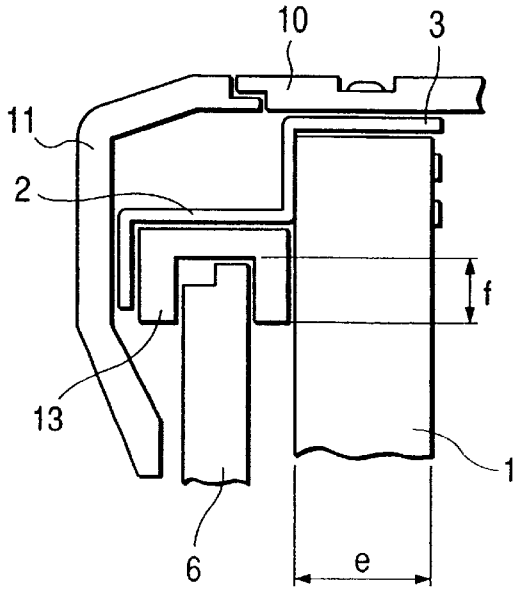
FIGS. 2A and 2B are enlarged views of corners of an X-character shaped supporting member of the first embodiment.
Figure 2B:
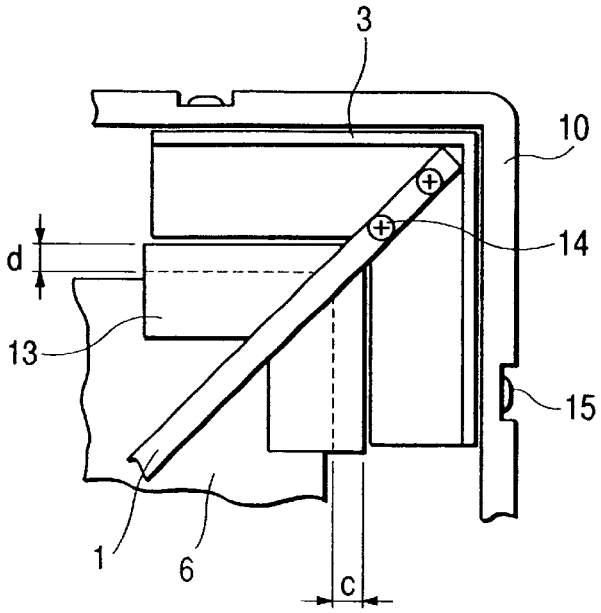

FIG. 2A is an enlarged vertical cross sectional view of the corner of the X-character shaped supporting member, and FIG. 2B is a plan view of the corner as viewed from the back side of the image forming apparatus. In FIGS. 2A and 2D, like elements to those shown in FIG. 1 are represented by using identical reference numerals. As shown in FIG. 2A, a buffer member 13 is provided near each corner of the flat panel 6 and fitted in the inner area of the flat panel fixing part 2. As shown in FIG. 2B, small screws 14 fix the cover fixing part 3 to the X-character shaped supporting member 1, and small screws 15 fix the rear cover 10 to the cover fixing part 3.

The detailed descriptions of the function and aspects of this mount structure will be further given. The X-character shaped supporting member 1 has two bars extending along diagonal lines of the flat panel 6 and crossing at the center thereof. The four corners of the X-character shaped supporting member 1 mechanically fix the flat panel 6. The four corners of the rear cover 10 are also mechanically fixed to the X-character shaped supporting member 1. Therefore, irrespective of a relatively small weight of the X-character shaped supporting member 1, the supporting member 1 provides a sufficient strength against an external load along the X- and Y-directions.

The cross section of each of the two bars of the X-character shaped supporting member 1 is a rectangle whose longer side extends along the Z-direction shown in FIG. 1. The longer side length e shown in FIG. 2A is designed to satisfy the following formula:

$$e \geqq \text{diagonal line length of flat panel } \mathbf{6} \times 1/80$$

With this formula, irrespective of a relatively small weight of the X-character shaped supporting member 1, the supporting member 1 can provide a sufficient strength against an external load along the Z-direction. In this embodiment, in order to reduce the weight of the apparatus, aluminum is used as the material of the X-character shaped supporting member 1. If the apparatus is to be thinned, iron or stainless steel may be used to shorten the longer side length e. The mechanical strength becomes sufficient if the longer side length e satisfies the above formula. However, if the longer side length becomes too large; the apparatus becomes thick. Therefore, the length is generally set in the range satisfying the following formula:

$$e \leqq \text{diagonal line length of flat panel } \mathbf{6} \times 1/20$$

The threaded mount members 4 of the X-character shaped supporting member 1 for mounting the electronic component mounting board 8 are provided with a relatively broad flat surface in contact with the board 8 and internal threads are formed in this flat surface, so that the board 8 can be reliably fixed with commercially available small screws. The board 8 is mounted on the X-character shaped supporting member 1 so that a ground wiring pattern (not shown) of the board 8 can be made in contact with the X-character shaped supporting member 1, to thereby allowing the supporting member 1 to be used as the ground line. The rear cover 10 is fixed to the X-character shaped supporting member 1 at respective four corners by small screws 15, so that the rear cover with an electromagnetic shield (to be described later) can also be connected to the ground line.

The reinforcing plate 9 is fixedly mounted on the X-character shaped supporting member 1 by the mounting member 5 with small screws, so that the reinforcing plate 9 can also be connected to the ground line. The wall hanger or desktop stand for mounting the apparatus having the flat display panel can also be used as the ground line.

As shown in the cross sectional view of FIG. 2A, the flat panel fixing part 2 has an L-character structure engaging with the front corner surface of the flat panel. In this embodiment, the buffer 13 is fitted in between this L-character shaped structure and the end of the X-character shaped supporting member 1. The buffer 13 has a right angle shape at each corner of the flat panel as viewed from the front or back surface side, and its cross section is a channel shape covering and engaging with the corner of the flat panel as shown in FIG. 2A. The buffer 13 together with the flat panel 6 can be dismounted from the X-character shaped supporting member 1 by using the small screws as shown in FIG. 2B.

The size of the damper is designed so that the following formulas are satisfied with respect to the depth f (depth $f_1$ in the horizontal direction and depth $f_2$ in the vertical direction) of a groove of the buffer 13 engaging with the corner of the flat panel as shown in FIG. 2A and the depths c (in the horizontal direction) and d (in the vertical direction) of the buffer deeper than the depth of the groove.

$$(\text{coefficient of thermal expansion of flat panel } \mathbf{6} - \text{coefficient of thermal expansion of } X\text{-character shaped supporting member } \mathbf{1}) \times 40\ [\text{deg}] \times \text{horizontal length [mm] of flat panel } \mathbf{6} \times 1/2 < f_1 \text{ and } c,$$

and $$(\text{coefficient of thermal expansion of flat panel } \mathbf{6} - \text{coefficient of thermal expansion of } X\text{-character shaped supporting member } \mathbf{1}) \times 40\ [\text{deg}] \times \text{horizontal length [mm] of flat panel } \mathbf{6} \times 1/2 < f_1 \text{ and } c$$

If the buffer is designed to satisfy the above formulas, the flat panel 6 can be supported reliably under an allowable temperature change during apparatus transportation and actual use.

In order to electrically insulate the flat panel 6 from the X-character shaped supporting member 1, the material of the buffer is preferably a good insulator such as various synthetic rubber of silicon-based, urethane-based, or the like. A rubber rigidity is to be determined from the weight of the flat panel 6, and is preferably set to 50 degrees or higher with a life time change being taken into consideration. If the rubber is too rigid, a stress may be applied to the flat panel 6 so that the rubber rigidity is generally set to 80 degrees or lower.

The cover fixing part 3 is formed so that a broad flat surface thereof can become in contact with the rear cover which is fixed to the X-character shaped supporting member 1 with screws 14 as described earlier, and with screws 15. Even if the aluminum plate is used, a sufficient strength can be achieved by the shapes shown in FIGS. 2A and 2B of the flat panel fixing part and cover fixing part formed through drawing and bending works.

A flat panel usable by the invention is not particularly limited so long as it is thin. It is preferable to use a flat panel having a thickness of 1.5 cm or thinner, or more preferably 1 cm or thinner. A flat panel of a self-light-emission type is particularly preferable. For example, flat plane type image forming apparatuses using surface conduction electron emitter, plasma discharge elements, or organic thin film EL elements are preferable.

The invention is particularly suitable for fixing a large size flat panel, such as flat panels of 30 to 60 inches.

In this embodiment, a flat plane type image forming apparatus with the flat panel 6 using surface conduction electron emitter is used.

The flat plane type image forming apparatus using surface conduction electron emitter has a structure that a front glass substrate and a rear glass substrate are adhered together via spacers, with a space therebetween being maintained vacuum. The inner surface of the front glass substrate is formed with fluorescent films for displaying an image through light emission and black stripe films for improving a contrast of the image. A metal back film is formed on the fluorescent and black strips films. The outer surface of the front glass substrate is coated with a lamination of resin films stacked together with adhesive for preventing broken glass from being scattered, and a conductive film for preventing charges from being accumulated and a low reflection film for improving the contrast, respectively formed on the lamination film. The inner surface of the rear glass substrate is formed with electron emitting elements in an area corresponding to the fluorescent films on the front glass substrate.

The electron emitting element is formed in the following manner. On a glass substrate, positive and negative electrodes to be used for electron emission are first formed facing each other spaced apart by several tens $\mu$m Next, an X-direction wiring line is formed through printing, for supplying an electrical signal from the outside of the flat panel to the positive electrode, and thereafter an interlayer insulating film for electrically insulating the X-direction wiring line from a Y-direction wiring line to be described later, is formed on cross point areas between the X- and Y-direction wiring lines. Thereafter, the Y-direction wiring line is formed through printing, for supplying an electrical signal from the outside of the flat panel to the negative electrode. A conductive thin film made of fine particles is then formed for coupling the positive and negative electrodes. An electron emitting area is formed partially in the conductive thin film by applying a proper potential across the positive and negative electrodes.

In operation of an electron emitting element, a voltage of +several volts is applied across the X- and Y-direction wiring lines of the flat panel 6 selected externally, to thereby emit electrons from the electron emitting element. The electrons are accelerated by a positive potential of several kV applied to the metal back film on the inner surface of the front glass substrate and collide with the fluorescent film to emit light.

One ends of the flexible flat cable 7 are connected via anisotropic conductive films to the X- and Y-direction wiring layers at the outer peripheral area of the flat panel, and the other ends thereof are connected via a connector to the electronic component mounting board 8. A ferrite core (not shown) for suppressing electromagnetic radiation noises is provided surrounding the intermediate portion of the flexible flat cable 7.

The electronic component mounting board 8 processes external signals and outputs signals for driving the flat panel. For example, it separates a sync signal from signals supplied from the tuner, outputs a modulation signal by using a shift register and a line memory, and outputs a scan signal by using a controller. These signals are supplied via the flexible flat cable 7 to the X- and Y-direction wiring lines to drive electron emitting elements of the flat panel 6 and display an image.

A projection of the reinforcing plate 9 passes through an opening in the electronic component mounting board 8 and is fixedly mounted directly on the mounting member 5 of the panel supporting member l with screws (not shown). Screws (not shown) are provided on the back side of the reinforcing plate 9, protruding to the outside of the housing of the apparatus in order to fix the apparatus to a desktop stand or wall hanger (not shown). The image forming apparatus fixed to the stand or hanger is tilted right and left or up and down in during its use. However, the X-character shaped supporting member 1 has a shape having two bars crossed along the diagonal lines of the flat panel, and the reinforcing plate 9 is positioned generally at the center of gravity of the apparatus. Therefore, the position of the apparatus becomes stable in any use conditions of the apparatus.

The front and rear covers 11 and 10 may be made of mold resin such as polycarbonate. The whole inner surfaces of the front and rear covers 11 and 10 are generally plated with metal (such as copper and nickel) in order to suppress electromagnetic radiation noises. Instead of metal plating, conductive paint containing copper or nickel particles may be coated.

The input cable 12 is electrically connected to an external tuner and power source (not shown) to receive external signals, the input cable 12 being passed through the wall of the rear cover 10. A ferrite core (not shown) for suppressing electromagnetic radiation noises is provided surrounding the signal lines of the tuner. Each line of the power source is made resistant to a high voltage.

In the above embodiment, the X-character shaped supporting member 1 supports all the components of the image forming apparatus, so that the mechanical strength of the apparatus can be improved and the weight of the apparatus can be reduced considerably because of incorporation of the X-character shaped supporting member 1. The X-character shaped supporting member 1 can deal with the expansion and contraction of the flat panel 6 to be caused by a change in the ambient temperature, so that the reliability of the apparatus can be improved. Since the front and rear covers and the like can be grounded via the X-character shaped supporting member 1, the electromagnetic shield effects are excellent. Furthermore, since the apparatus can be fixed to the desktop stand or wall hanger near at the position where the center of gravity of the apparatus is present, stability and handling of the apparatus can be improved.

When the apparatus is dumped, by dismounting all screws, the components can be easily dismounted, including resin covers and board and the like, glass flat panel, and metal supporting member.

[Second Embodiment]

Figure 3:
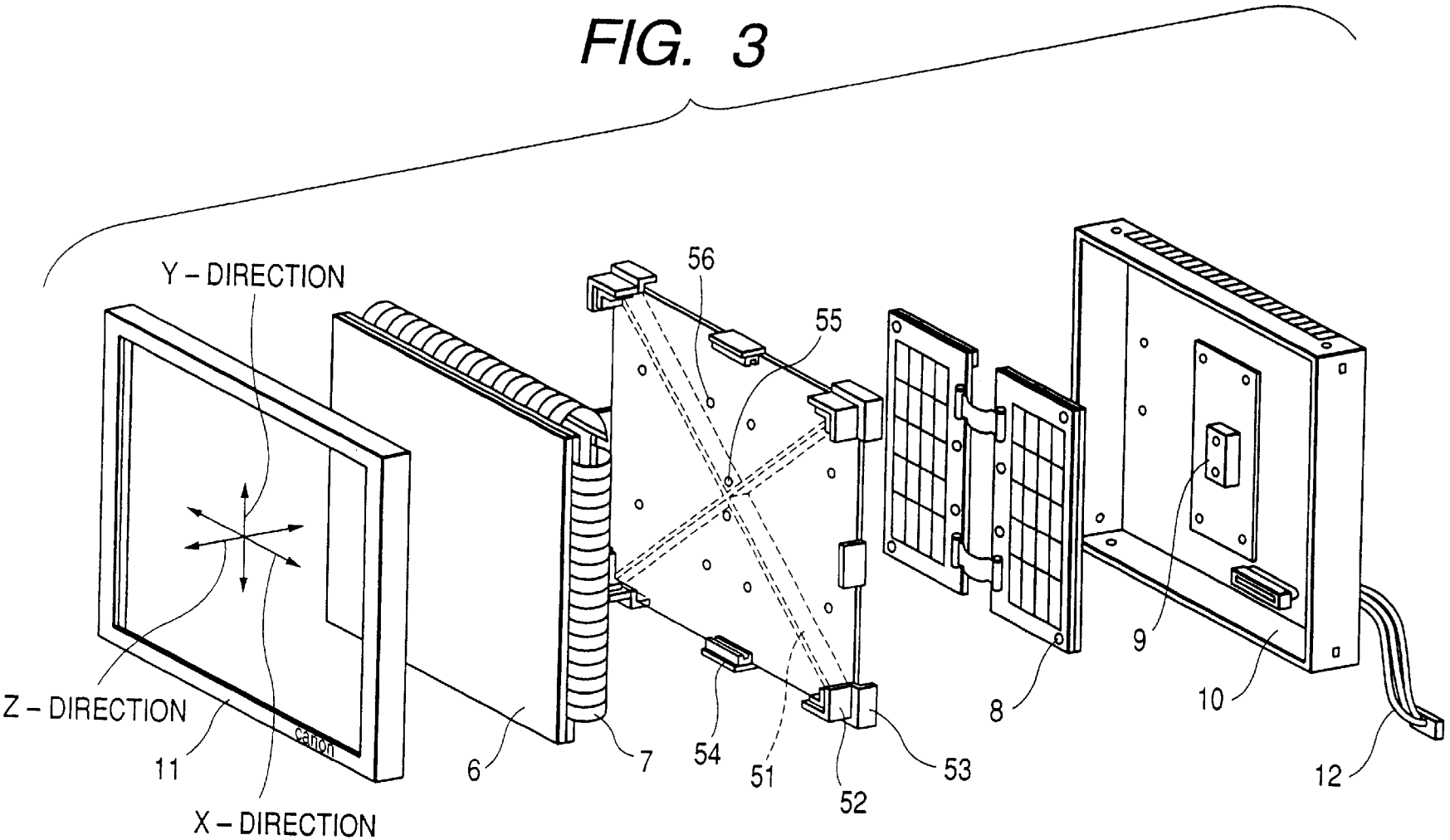
FIG. 3 is a broken perspective view of an image forming apparatus according to a second embodiment of the invention.

FIG. 3 is a schematic diagram showing the structure of a flat plane type image forming apparatus according to the second embodiment of the invention. In FIG. 3, like elements to those of the first embodiment are represented by using identical reference numerals. In the second embodiment, a flat panel is supported by an X-character shaped supporting member and a thin plate. Specifically, a flat panel supporting member 51 is constituted of a thin plate and an X-character rib (X-character shaped supporting member) integrated with the thin plate through welding or screws. A flat panel fixing part 52 for fixing each corner of the flat panel 6 is provided at each corner of the flat panel supporting member, and a cover fixing part 53 is also provided at each corner of the flat panel supporting member. Fixing members 54 for fixing the central area of fours sides of the flat panel 6 are further provided. The thin plate is formed with a threaded mount area 55 with threaded holes for mounting the reinforcing plate 9 and with another threaded mount area with threaded holes 56.

Figure 4:
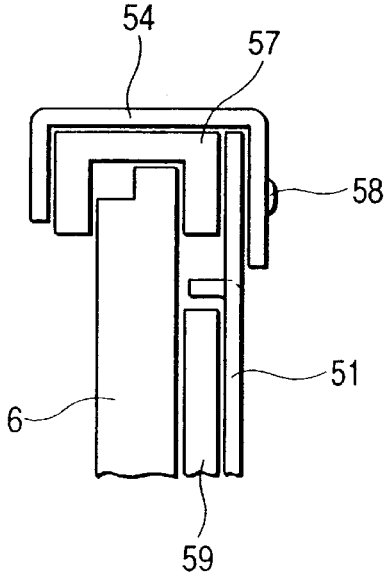
FIG. 4 is an enlarged vertical cross sectional view showing part of a fixing member at the central side of a flat panel of the second embodiment.

FIG. 4 is an enlarged vertical cross sectional view showing the fixing member 54 at each side of the flat panel 6. A buffer member 57 is held by the fixing member 54 which is fixed to the flat panel supporting member 51 with a small screw 58. A heat insulating sheet 59 is provided in a space between the flat panel 6 and the thin plate of the flat panel supporting member 51, the positioning of the heat insulating sheet 59 being realized by a cut-bend work of the thin plate of the flat panel supporting member 51.

The detailed descriptions of the function and aspects of this mount structure will be further given. The components without particular description in the following have the same structure as the first embodiment.

The rib of the flat panel supporting member 51 is fixed to the thin plate along diagonal lines of the flat panel 6 and crossing near at the center thereof. Similar to the first embodiment, the flat panel 6 is fixed via the dampers to the flat panel fixing parts 52 with small screws at the four corners of the flat panel supporting member 51. Similarly, the rear cover 10 is fixed to the rear cover fixing part 53 with small screws at the four corners of the flat panel supporting member 51. With this structure, similar to the first embodiment, irrespective of a relatively small weight of the flat panel supporting member 51, the supporting member 51 provides a sufficient strength against an external load along the X- and Y-directions.

The cross section of each of the two bars of the rib of the flat panel supporting member 51 is a rectangular whose longer side length e is designed to satisfy the following formula:

$$e \geqq \text{diagonal line length of flat panel } \mathbf{6} \times 1/160$$

With this formula, irrespective of a relatively small weight of the flat panel supporting member 51, the supporting member 51 can provide a sufficient strength against an external load along the Z-direction.

In this embodiment, in order to reduce the weight of the apparatus, aluminum is used as the material of the flat panel supporting member 51. If the apparatus is to be thinned, iron or stainless steel may be used to shorten the longer side length e. The mechanical strength becomes sufficient if the longer side length e satisfies the above formula.

In this embodiment, the four sides of the flat panel 6 is fixed to the fixing parts 54. This structure suppresses a deflection of the glass substrates of a flat display panel such as a large flat display panel having a diagonal length of 30 inches or longer and a light weight flat display panel having thin glass substrates. Although the glass substrate has a thickness of 2.8 mm in this embodiment, a glass substrate having a thickness of 2 mm or thinner may also be used without generating any deflection.

Also in this embodiment, since the thin film of the flat panel supporting member 51 is disposed facing the flat panel 6, a space therebetween can be used for inserting the heat insulating sheet 59 for intercepting thermal conduction therethrough or a protective buffer sheet (not shown) for protecting the flat panel.

This embodiment with the flat panel supporting member 51 having the integral structure of the X-character shaped rib and thin plate, is applicable also to the case where a large flat panel is used or the weight of the apparatus is reduced.

It is also possible to use the heat insulating sheet for suppressing interference between heat generated by the flat panel and heat generated by the electronic component mounting board 8 or to use a protective buffer sheet for protecting the flat panel. Accordingly, the display performance of the apparatus can be improved and the use environmental conditions can be alleviated.

Furthermore, since the flat plate of the flat panel supporting member at the electrically ground potential is disposed between the flat panel 6 and electronic component mounting board 8, the effects of preventing radiative noises can be improved. Accordingly, metal plating (electromagnetic shielding) on the inner surface of the rear cover is not necessary and the manufacture cost can be reduced considerably.

[Third Embodiment]

Figure 5:
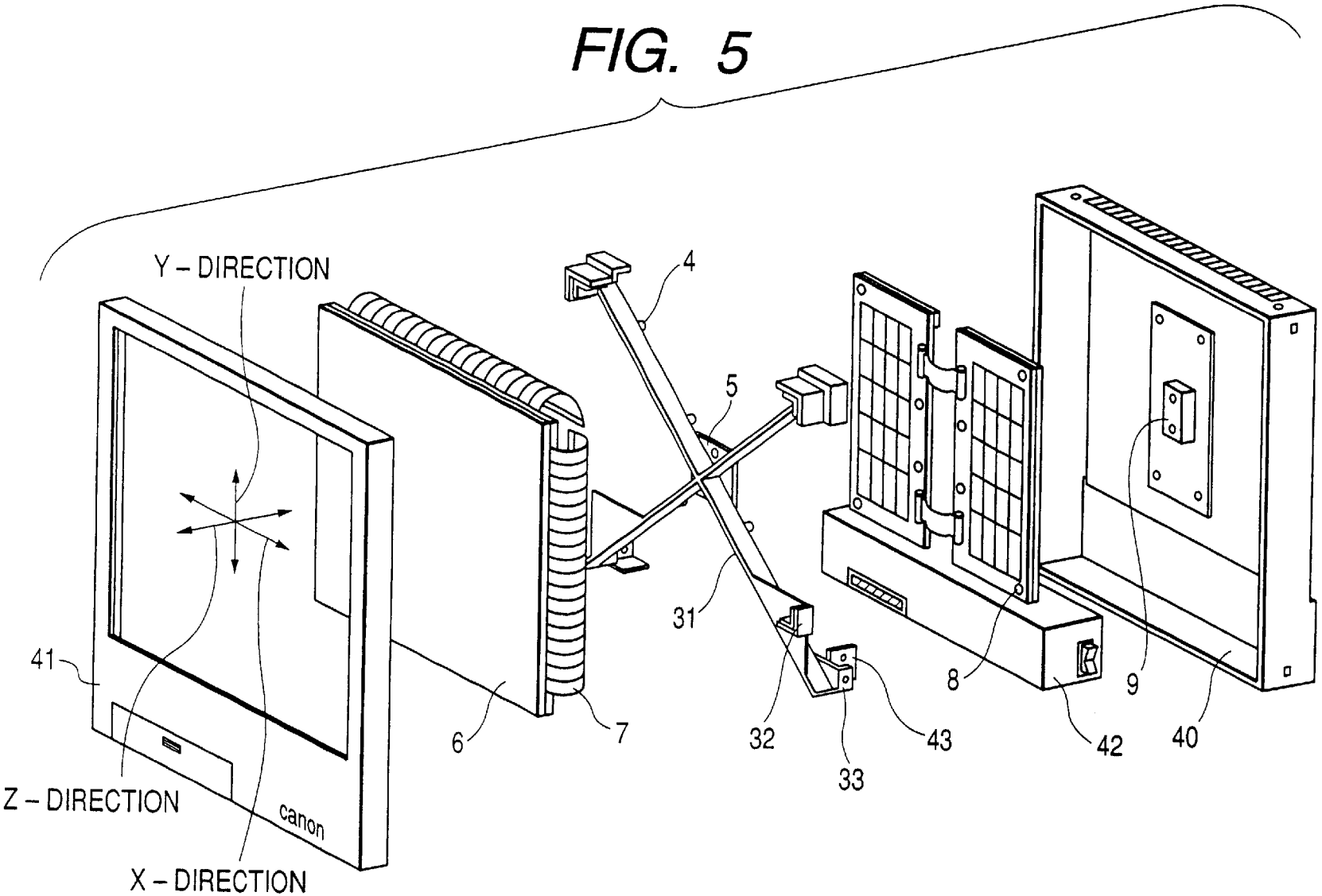
FIG. 5 is a broken perspective view of an image forming apparatus according to a third embodiment of the invention.

FIG. 5 is a schematic diagram showing the structure of a flat plane type image forming apparatus according to the third embodiment of the invention. In FIG. 5, like elements to those of the first embodiment are represented by using identical reference numerals. In the third embodiment, a signal source unit is accommodated in the housing of the apparatus, and an X-character shaped supporting member supports the flat panel and the signal source unit. The X-character shaped supporting member 31 is made of a rigid material and has flat panel fixing parts 32 at the four corners of the supporting member. Signal source unit fixing parts 43 for fixing the signal source unit (to be described later) are also provided at the two corners lower than the two flat panel fixing parts 32. A cover fixing part 33 is also provided at the furthest four corners of the X-character shaped supporting member 31. The signal source unit 42 has the electronic component mounting board 8 mounted thereon. The signal source unit 42 supplies an electric power and signals to the board a and has a built-in tuner, an input unit for receiving an AC power and signals, and an output unit for supplying a DC power and signals. The lower space of the rear cover 40 is used for accommodating the signal source unit 42. The front cover 41 is provided with an opening corresponding to the display screen and with a circuit board (not shown) for adjusting a displayed image quality.

The detailed descriptions of the function and aspects of this mount structure will be further given. The components without particular description in the following have the same structure as the first embodiment.

Two bars of the X-character shaped supporting member 31 are disposed along diagonal lines extending between the upper two corners of the flat panel 6 and the lower two fixing parts for the signal source unit, and crossing near at the central height position of the flat panel 6 and signal source unit 42 disposed up and down. Therefore, similar to the first embodiment, the flat panel 6 is fixed via the dampers to the four fixing parts 32 at the four corners with small screws. Similarly, the rear cover 40 is fixed to the fixing parts 33 with small screws at the four corners. The signal source unit fixing members 43 at the lower two corners of the X-character shaped supporting member 31 mechanically fix the signal source unit 42. With this structure, irrespective of a relatively small weight of the X-character shaped supporting member 31, the supporting member 31 provides a sufficient strength against an external load along the X- and Y-directions.

The material of the X-character shaped is supporting member 31 and the cross section of each of the two bars are the same as those of the first embodiment, and the electrical connection to and from peripheral components are also the same as that of the first embodiment.

As shown in FIG. 5, the signal source unit 42 is positioned lower in the apparatus. Since the signal source unit 42 having a large amount of heat generation is placed lower, the internal temperature of the apparatus can be made uniform by air convection. The signal source unit 42 has a sufficient mechanical strength by itself, which has a signal source board and a tuner board electrically separated by an insulating material and housed in a metal case.

In this embodiment, the signal source unit 42 is assembled in the image forming apparatus so that the space of the apparatus can be used efficiently. Furthermore, since the X-character supporting member 31 supports all components of the apparatus, the mechanical strength of the apparatus can be improved and the weight of the apparatus can be reduced considerably because of incorporation of the X-character shaped supporting member 31. Furthermore, since the apparatus can be fixed to the desktop stand or wall hanger near at the position where the center of gravity of the apparatus is present, stability and handling of the apparatus can be improved.

[Fourth Embodiment]

FIG. 8 is a plan view showing, in the form easiest to understand, the structure of a flat plane type image forming apparatus according to the fourth embodiment of the invention, as viewed from the back side of the display panel. The description of portions common to the first embodiment Is omitted. In FIG. 8, reference numeral 91 represents a flat panel supporting member made of a rigid material and having two X-character ribs disposed vertically. Reference numeral 92 represents a part fixing a flat panel 94. The fixing part 92 is formed at each corner of the flat panel supporting member 91, and reference numeral 93 represents an electronic component mounting board. Six such boards having different sizes are mounted on the flat panel supporting member 91. Reference numeral 94 represents a flat panel, and reference numeral 95 represents a threaded mount member provided at the right and left sides of the flat panel supporting member 91, the threaded mount member mounting a reinforcing plate (not shown). Reference numeral 96 represents a screw for fixing each electronic component mounting board 93 directly to the flat panel supporting member 91.

The function and aspect of each component of this mount structure will be described sequentially.

The flat panel supporting member 91 has four rods disposed along diagonal lines extending between the four corners of the flat panel 94 and two central points of the two short sides. The flat panel supporting member 91 has a shape of a combination of a rhomboid and triangles. The length of each rod is longer than the length of the longer side of the flat panel.

The flat panel 94 is fixed at its four corners with screws. Therefore, irrespective of a relatively small weight of the flat panel supporting member 91, the supporting member 91 provides a sufficient strength against an external load along the X- and Y-directions. The material of the flat panel supporting member 91 and the cross section of each of the four bars are the same as those of the first embodiment, and a sufficient strength against an external load along the Y-direction can be provided. The material of the flat panel supporting member 91 may be a material having a lower rigidity to reduce the weight of the apparatus, such as resin mold. Even with such a material, the mechanical strength of the flat panel supporting member 91 is sufficient because of its specific structure. In this embodiment, six electronic component mounting boards 93 divisionally disposed as shown in FIG. 8 are reliably fixed to the flat panel supporting member 91 with fixing screws 96. Therefore, similar to the first embodiment, if the ground wiring line of each electronic component mounting board 93 is connected to the contact area of the fixing screw 96, electrical connection with peripheral components can be retained.

The mount member 95 for the reinforcing plate is disposed at the right and left sides of the flat panel supporting member 91 at the height generally flush with the center line of the flat panel. Therefore, if the apparatus is fixed to the desktop stand or wall hanger, the center of gravity of the flat panel can be supported uniformly.

As described above, in the fourth embodiment, it is possible to fix a number of electronic component mounting boards directly to a panel supporting member, so that reliability of the electrical connection can be improved and electromagnetic radiation noises from the flat panel and electronic component mounting boards can be reliably shielded. Further, since the flat panel supporting member supports all components of an image forming apparatus, the mechanical strength of the whole of the apparatus can be enhanced and the weight of the apparatus can be reduced considerably because of the specific structure of the supporting member. Still further, since the apparatus can be fixed directly to the desktop stand or wall hanger by utilizing the flat panel supporting member, both stability and handling of the apparatus can be improved.

The invention has been described with reference to the embodiments. The invention is not limited only to the above embodiments, but is applicable to various other fields. For example, in the second embodiment, the supporting member constituted of the rib and thin plate has the fixing parts at the four corners of the rib, and the mount members of the thin plate fix the central areas of respective sides of the flat panel. Instead, a plurality of mount members may be provided for each opposing side of the flat panel and fixed only to a rib without using plate member.

As described so far, since the flat panel is holded at its contrary surfaces by the panel supporting member, a deflection of the panel is not likely to occur even if there is an ambient temperature change or a change in heat generation of the flat panel itself, and the flat panel can be supported reliably.

Since a portion of the panel supporting structure has a rod made of a material different from that of the flat panel, the weight of the apparatus can be reduced.

What is claimed is:

1. A panel apparatus comprising:

a panel for displaying an image and a panel support structure for supporting the panel, the support structure comprising:

a plurality of holding members, each of which is astride an edge of the panel, and a supporting member having a metal rod-like structure, wherein one of said plurality of holding members is connected to each end of said rod-like structure.

2. A panel apparatus according to claim 1, wherein said holding members are provided with a damper at a position where the panel is adapted to come in contact with said holding members.

3. A panel apparatus according to claim 1, wherein said holding members are disposed generally along a surface of the panel.

4. A panel apparatus according to claim 1, wherein said supporting member includes a plate member.

5. A panel apparatus according to claim 1, wherein a length of said rod-like member along a longitudinal direction is greater than a length of a longer side of the panel.

6. A panel apparatus according to claim 1, wherein said panel is made of glass.

7. A panel apparatus according to claim 1, wherein said panel has a front glass substrate and a rear glass substrate which are adhered to one another.

8. A panel apparatus according to claim 1, wherein said supporting member comprises plural rod-like members crossing each other.

9. A panel apparatus according to claim 1, wherein a length of a cross section of said rod-like member along a thickness direction of the panel is greater than a length of the cross section along a direction parallel to a surface of the panel.

10. A panel apparatus according to claim 1, wherein a length of a cross section of said rod-like member along a thickness direction of the panel is at least 1/80 of a length of a diagonal line of the panel.

11. A panel apparatus according to claim 1, wherein said holding members alone, or said holding members and a part of said supporting member, contact with the panel.

12. A panel apparatus according to claim 1, wherein at least a portion of the panel support structure is electrically grounded.

13. A panel apparatus according to claim 1, wherein the panel support structure has a mount portion for mounting a cover which accommodates at least a portion of a panel display device that includes the panel and the panel support structure.

14. A panel apparatus according to claim 1, wherein the panel support structure has a mount portion for mounting a circuit board for controlling or driving the panel.

* * * * *

UNITED STATES PATENT AND TRADEMARK OFFICE

CERTIFICATE OF CORRECTION

PATENT NO. : 6,494,429 B2
DATED : December 17, 2002
INVENTOR(S) : Hisao Tajima

It is certified that error appears in the above-identified patent and that said Letters Patent is hereby corrected as shown below:

Column 2,
Line 24, “which” should be deleted;
Line 64, “Wherein,” should read -- The --;
Line 65, “includes” should read -- may be --; and
Line 66, “members” should read -- member --.

Column 3,
Lines 4, 6, 38 and 40, “crossed” should read -- crossed with --.

Column 4,
Line 33, “is” should be deleted.

Column 6,
Line 36, “2D,” should read -- 2B, --.

Column 7,
Line 7, “large;” should read -- large, --; and
Line 21, “allowing” should read -- allow --.

Column 8,
Line 6, “life time” should read -- lifetime --;
Line 10, “become” should read -- come --; and
Line 51, “μm Next,” should read -- μm. Next, --.

Column 10,
Line 19, “fours” should read -- four --; and
Line 66, “is” should read -- are --.

Column 11,
Line 52, “board a” should read -- board 8 --.

UNITED STATES PATENT AND TRADEMARK OFFICE

CERTIFICATE OF CORRECTION

PATENT NO. : 6,494,429 B2
DATED : December 17, 2002
INVENTOR(S) : Hisao Tajima

It is certified that error appears in the above-identified patent and that said Letters Patent is hereby corrected as shown below:

Column 12,
Line 12, "is" should be deleted; and
Line 43, "Is" should read -- is --.

Column 13,
Line 53, "holded" should read -- held --.

Signed and Sealed this

Eighth Day of July, 2003

JAMES E. ROGAN
*Director of the United States Patent and Trademark Office*